US005689754A

United States Patent [19]

Yoshida et al.

[11] Patent Number: 5,689,754

[45] Date of Patent: Nov. 18, 1997

[54] REGENERATING APPARATUS FOR RECORDING MEDIUM

[75] Inventors: Masazumi Yoshida, Amagasaki; Junji Machida; Kaoru Furusawa, both of Toyonaka, all of Japan

[73] Assignee: Minolta Co., Ltd., Osaka, Japan

[21] Appl. No.: 329,480

[22] Filed: Oct. 26, 1994

[30] Foreign Application Priority Data

Oct. 28, 1993 [JP] Japan ..... 5-270339
Oct. 28, 1993 [JP] Japan ..... 5-270350

[51] Int. Cl.[6] ..... G03G 21/00

[52] U.S. Cl. ..... 399/1; 118/424; 162/4; 162/265; 399/390

[58] Field of Search ..... 355/202, 297, 355/308; 15/77; 162/4, 265; 118/70, 203, 423, 424, 602, 603, 699, 702, 696; 156/281; 399/390, 1

[56] References Cited

U.S. PATENT DOCUMENTS

| | | | |
|---|---|---|---|
| 3,630,776 | 12/1971 | Barr | 355/297 |
| 5,353,108 | 10/1994 | Tsukamoto | 355/296 |
| 5,400,123 | 3/1995 | Sato et al. | 15/77 X |
| 5,474,617 | 12/1995 | Saito et al. | 355/307 X |
| 5,545,381 | 8/1996 | Iida et al. | 355/308 X |

FOREIGN PATENT DOCUMENTS

| | | |
|---|---|---|
| 4-89271 | 3/1992 | Japan . |
| 4-91298 | 3/1992 | Japan . |
| 5-216376 | 8/1993 | Japan . |
| 5-323832 | 12/1993 | Japan . |
| 6-161326 | 6/1994 | Japan . |

*Primary Examiner*—Nestor R. Ramirez
*Attorney, Agent, or Firm*—Sidley & Austin

[57] ABSTRACT

A regenerating apparatus for removing a printing material from a recording medium so as to reuse the recording medium includes a container, a container for accommodating a liquid for swelling the printing material; a guide member for guiding the recording medium, part of which is arranged in the liquid; a rotatable transporting roller for transporting the recording medium along the guide member, so that the printing material on the recording medium is immersed in the liquid; a rotatable transferring roller disposed near the guide member so as to be in contact at a circumferential surface thereof with the recording medium and receive the printing material swollen by the liquid from the recording medium. The surface of the transferring roller is formed with at least one of the materials selected from polyolefin resin, polyester resin, nitrogen containing resin, sulfur containing resin, fluororesin, silicon resin, polyacetal resin, epoxy resin, polyether ether ketone resin, and phenol resin.

19 Claims, 9 Drawing Sheets

REGENERATING APPARATUS FOR RECORDING MEDIUM

BACKGROUND OF THE INVENTION

1. Field of the Invention

The present invention relates to an apparatus for regenerating a recording medium by removing a printing material from the recording medium such as paper having images printed by an image forming apparatus such as copier or printer.

2. Description of the Prior Art

Conventionally, as a regenerating apparatus for removing a printing material such as toner from a recording medium or paper having an image printed by an image forming apparatus such as copiers, etc., in Japanese Patent Laid-Open Publication No. 5-173454, there is disclosed an apparatus comprising a heater roller for melting the printing material, a roller for receiving the printing material melted from the recording medium, and a blade for removing the toner transferred to this roller therefrom, and another apparatus for immersing the recording paper in a dispersant consisting of the wet type developing agent and thereby liberating to remove the toner images therefrom.

These regenerating apparatuses have technical problems, i.e., in the former regenerating apparatus, the roller must be able to transfer all the melted toner thereto, and in the latter regenerating apparatus, the liberated material must be prevented from readhering to the recording medium.

SUMMARY OF THE INVENTION

It is therefore an object of the present invention to provide an improved regenerating apparatus which is capable of fully removing a printing material from a recording medium.

It is another object of the present invention to provide a regenerating apparatus capable of preventing the printing material removed from the recording medium from readhering to the recording medium.

In accomplishing these and other objects, according to one aspect of the present invention, a regenerating apparatus comprises a container for accommodating a liquid for swelling the printing material; an applying means for applying the liquid to recording medium having the printing material; a transferring means for contacting the recording medium and receiving the printing material swollen by the liquid applied thereto from the recording medium; and a recovering means for recovering the printing material transferred to the transferring means. A portion of the transferring means to be in contact with the printing material on the recording medium is formed with at least one of the materials selected from polyolefin resin, polyester resin, nitrogen containing resin, sulfur containing resin, fluororesin, silicon resin, polyacetal resin, epoxy resin, polyether ether ketone resin, and phenol resin.

In a further aspect of the present invention, a regenerating apparatus includes a container for accommodating a liquid for swelling the printing material; a guide member for guiding the recording medium, part of which is arranged in the liquid; a transporting means for transporting the recording medium along the guide-member; a removing means disposed near the guide member to remove the printing material from the recording medium; a cleaning means for removing the printing material retained by the removing member therefrom; a switch for starting the apparatus; and a controller for driving the cleaning means when the switch is turned on.

In a still further aspect of the present invention, a regenerating apparatus includes a switch for instructing a starting of a regenerating operation against the recording medium using the transporting means; a timer for counting time passed from the regeneration operation previously executed; and a controller for driving the cleaning means prior to the regenerating operation provided that the counted time of the timer is greater than a predetermined time when the switch is turned on.

In a further aspect of the present invention, a regenerating apparatus includes a switch for instructing a starting of a regenerating operation against the recording medium using the transporting means; and a controller for prohibiting the staring of the regenerating operation based on an instruction of the switch when the cleaning means is in operation.

According to the above regenerating apparatuses, a liquid to swell the printing material is applied to the recording medium having images. This application method may be either by immersion or by application. The printing material applied with the above liquid swells and becomes ready to be easily removable from the recording medium. Then, the swollen printed material is transferred to the transferring means and recovered by the recovering means from the transferring means. When a portion of the transferring means to be in contact with the printing material is formed by at least one of the materials selected from multiple types of resins mentioned above, because these resins provide excellent absorbency and separability of the printing material, the transferring means may reliably receive the printing material on the recording medium and are completely removed by the recovering means.

BRIEF DESCRIPTION OF THE DRAWINGS

These and other objects and features of the present invention will become clear from the following description taken in conjunction with the preferred embodiments thereof with reference to the accompanying drawings throughout which like parts are designated by like reference numerals, and in which.

DETAILED DESCRIPTION OF THE PREFERRED EMBODIMENTS

1. Regenerating Device

Figure 1:
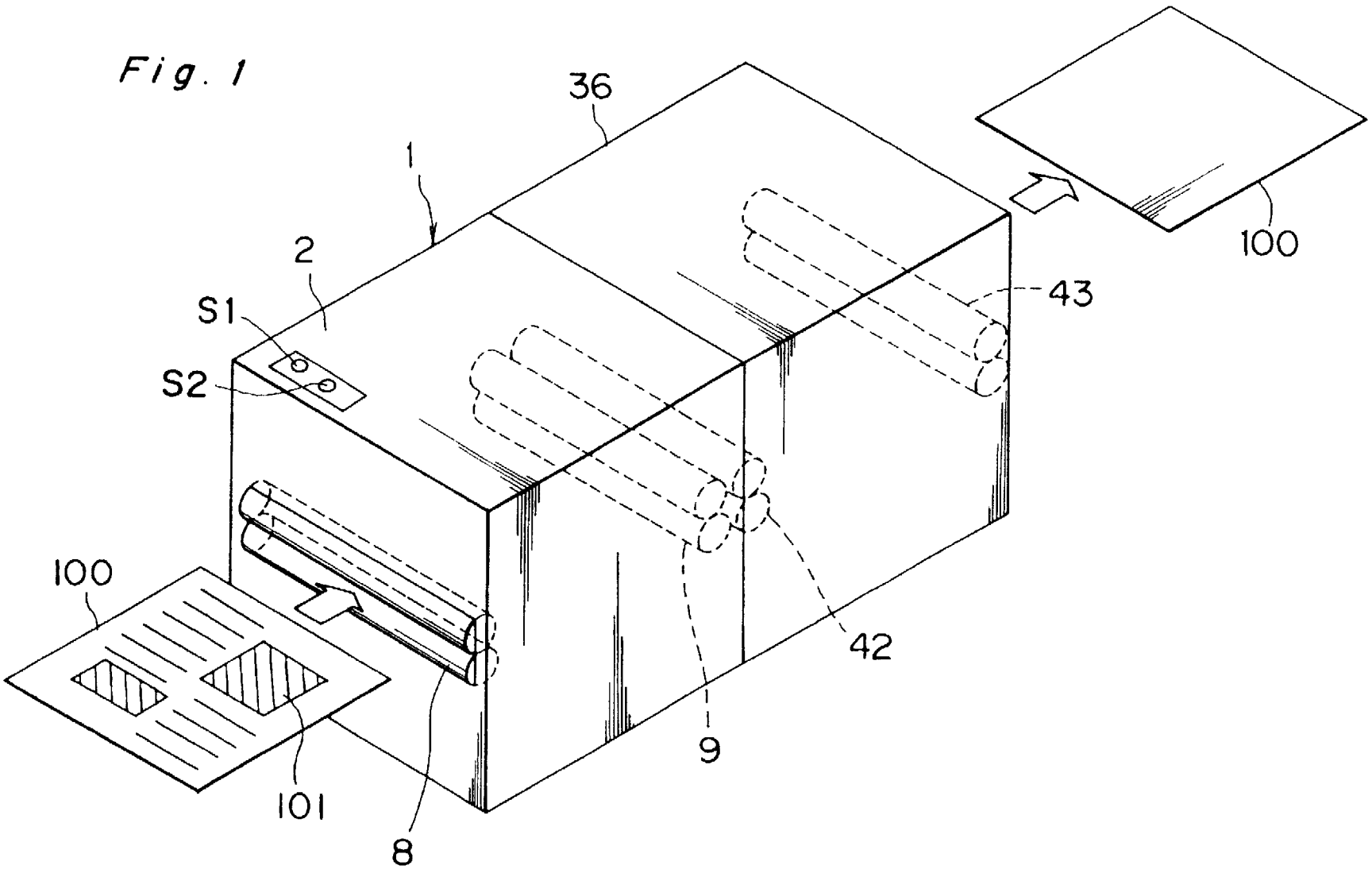
FIG. 1 is a perspective view of the regenerating apparatus according to the present invention.

Referring now to the drawings, there is shown in FIG. 1 a regenerating device 1 of the present invention for removing a printing material 101 such as toner from a recording medium 100 such as paper or OHP (Over Head Projector) transfer layer having an image printed and thereby regenerating the recording medium 100 into a recyclable condition. This regenerating device 1 comprises a wet-type cleaning unit 2 for removing the printing material 101 from the recording medium 100 and a drying unit 36 for drying the recording medium 100 from which the printing material has removed and then discharging the recording medium 100 in the recyclable condition.

Figure 2:
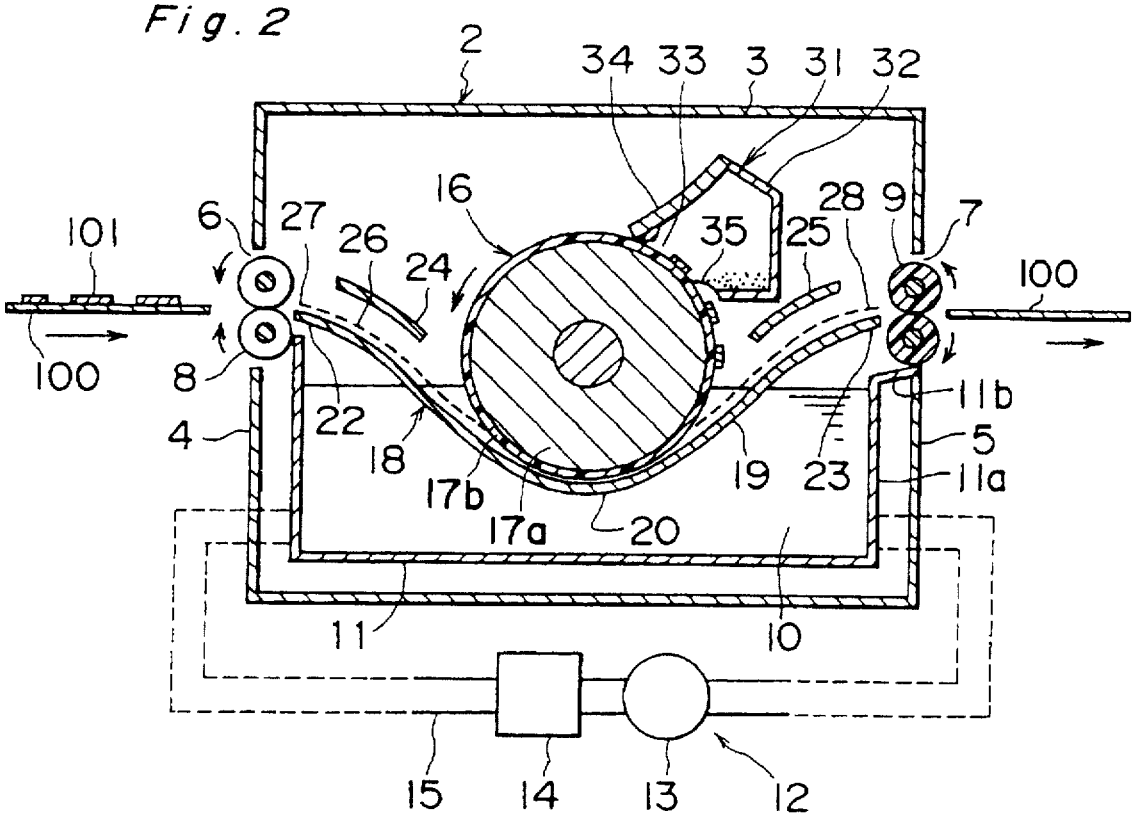
FIG. 2 is a cross sectional view of the cleaner.

Referring to FIG. 2, there is shown the cleaning unit 2 in detail which comprises a cleaning chamber 3 in a form of box. This chamber 3 includes openings 6 and 7 extending horizontally at charge-side and discharge-side walls 4 and 5, respectively. A pair of feed rollers 8 are arranged at or in the vicinity of the charge-side opening 6, while a pair of squeeze rollers 9, each circumference being covered by a elastic material such as rubber, is disposed at or in the vicinity of the discharge-side opening 7. These rollers 8 and 9 are drivingly connected to a motor not shown so as to rotate in the direction indicated by respective arrows.

A container 11 in a form of box for accumulating a cleaning liquid 10 comprises an opening at its top and is housed inside the cleaning chamber 3. This container 11 comprises at the top of its discharge-side wall **11*a* a recovery plate 11*b* which extends under the squeeze rollers 9 so that the liquid 10 dropping from the squeeze rollers 9 will be caught by the plate 11*b*. The cleaning liquid 10 contains a swelling agent for swelling the printing material 101** or toner, whose chemical composition will be later discussed in detail.

A circulating unit 12 of the cleaning liquid comprises a transferring pipe 15 in which a feed pump 13 and a filter 14 are connected in series, and both ends of this pipe 15 are coupled to the container 11, respectively. Although the circulating unit 12 is illustrated outside the cleaning chamber 3, it is desirable to install inside the cleaning chamber 3.

A transferring member, i.e., transferring roller 16 for transferring the printing material 101 swollen in the cleaning liquid 10 from the recording medium 100 thereto comprises a cylindrical body **17*a* and a circumferential transfer layer 17*b* covering the circumference of the cylindrical body 17*a*. The cylindrical body 17*a* is preferably made of elastic material such as polyurethane, silicon rubber or fluoride rubber, or a rigid material such as aluminum, stainless steel. The circumferential transfer layer 17*b* is preferably made of the material with excellent absorbency and separability against a swollen printing material 101. The material of the transfer layer 17*b* will be later discussed in detail. This transferring roller 16 is so arranged between the rollers 8 and 9 as to extend in parallel relation with these rollers 8 and 9 and to immerse preferably about one third or about one half from the bottom in the cleaning liquid 10. Also, this roller 16** is drivingly connected to a motor not shown to rotate in the direction indicated by the arrow.

Figure 3:
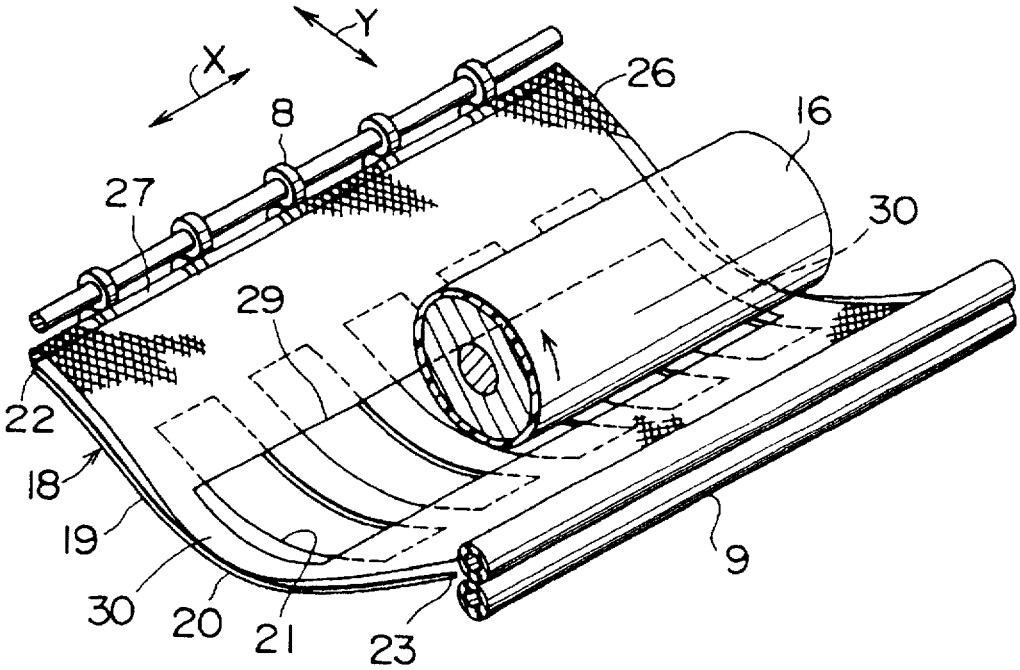
FIG. 3 is a perspective view of the means for guiding the recording medium in the cleaner.

A guide unit 18 for guiding the recording medium 100 fed to the cleaning chamber 3 into the cleaning liquid 10 and then out of the cleaning liquid 10 comprises a guide plate 19, which is made of metal or synthetic resin and is curved downwardly at its central portion 20. This plate 19 is so arranged below the transferring roller 16 as to allow the top surface at the central portion 20 to be in slight contact with the outer bottom surface of the transferring roller 16. Therefore, it is desirable to design that the central portion 20 has a lowermost curvature nearly equal to that of the transferring roller 16 and both sides of the central portions have curvatures greater than that of the central portion 20. The plate 19 has at its curved portion 20 a plurality of openings 21 extending in the longitudinal direction indicated by arrow Y as shown in FIG. 3 so that the cleaning liquid 10 is allowed to move past the openings 21 to contact the outer surface of the transferring roller 16.

On the guide plate 19 a sheet 26 for preventing the recording medium 100 from winding around the transferring roller 16 is arranged, and the edges 27 and 28 at the charge and discharge sides thereof are supported by, for example, wires not shown so that the edges 27 and 28 are spaced apart from the guide plates 22 and 23, respectively. This sheet 26 is preferably made of a mesh net formed with metallic or synthetic resin threads. Also, the sheet 26 has at its central portion facing the bottom surface of the transferring roller 16 an opening 29 extending transversely so that a transferring roller 16 faces the guide plate 19 directly.

Further, other guide plates 24 and 25 are arranged above both sides of the guide plate 19.

A cleaning unit 31 for removing the printing material or toner from the circumferential transfer layer **17*b* of the transferring roller 16 has a recovery container 32 which is arranged in parallel with the transferring roller 16. The recovery container 32 has an opening 33 facing the circumferential surface of the transferring roller 16. Fixed at the downstream and upstream sides of the opening 33 with respect to the rotation of the transferring roller 16 are a scraper 34 for removing the printing material from the transfer roller 16 and a sheet 35 for retaining the printing material recovered in the container 32, respectively, tip portions thereof being in contact with the circumferencial surface of the roller 16. The scraper 34 is preferably formed with elastic material such as rubber or thin metallic sheet, while the sheet 35** is preferably formed with soft sheet such as synthetic resin.

Figure 4:
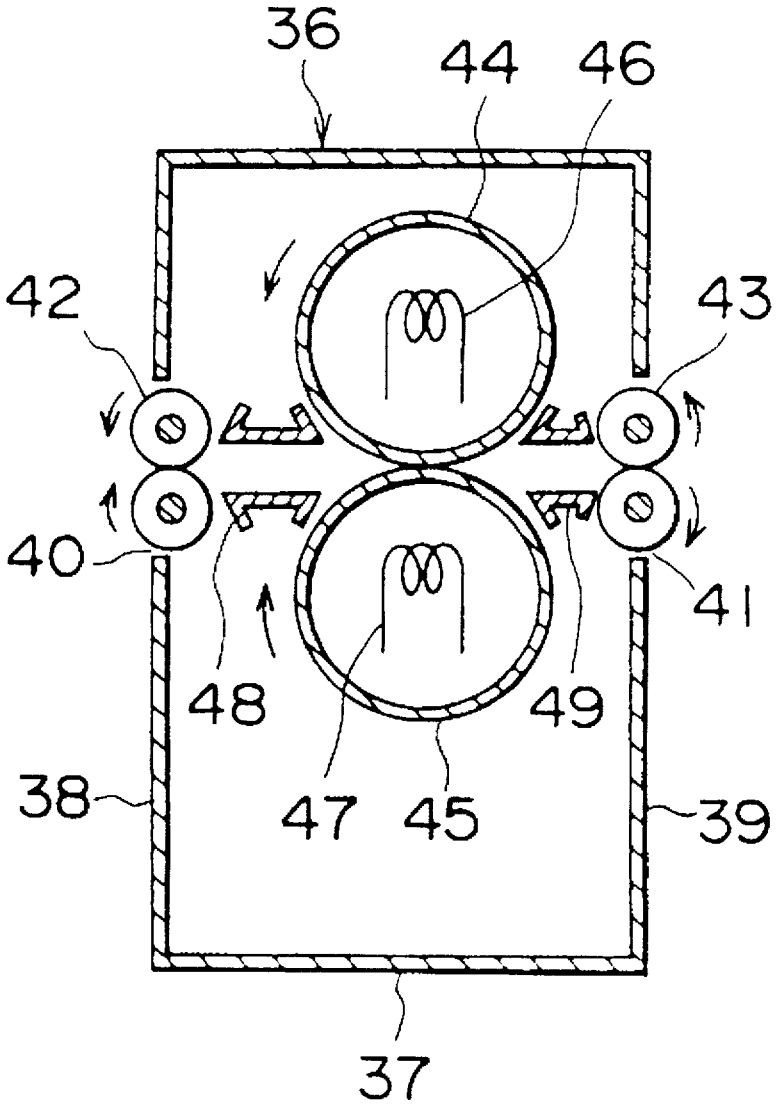
FIG. 4 is a cross sectional view of the dryer.
Figure 7:
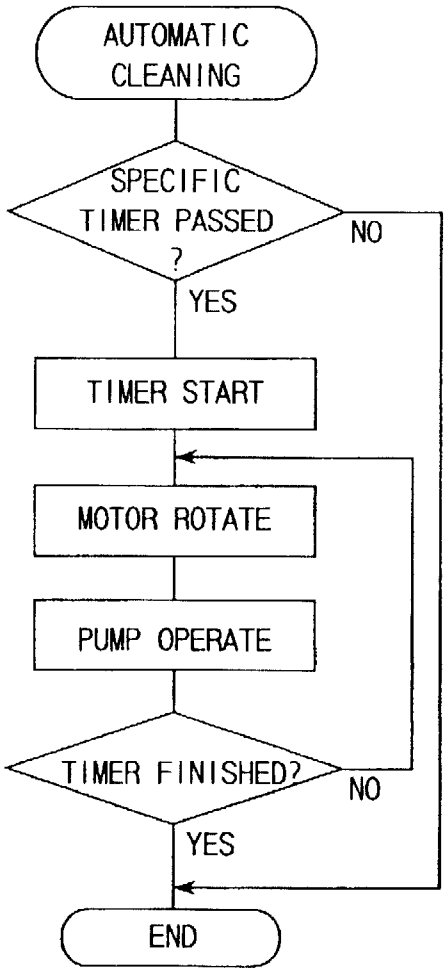
FIG. 7 is a flow chart showing the operation of automatic cleaning.

Referring to FIG. 4, the drying unit 36 comprises a drying chamber 37. This chamber 37 has openings 40 and 41 extending horizontally in the charge-side and discharge-side walls 38 and 39, respectively. Arranged at or in the vicinity of these openings 40 and 41 are two pairs of rollers 42 and 43, respectively, which rotate in the direction indicated by arrows by a motor not shown. The drying unit 36 also comprises a pair of heating rollers 44 and 45 having heaters 46 and 47 therein, respectively. These rollers 44 and 45 are arranged between the rollers 42 and 43 with one in contact with the top surface of the other. Also, these rollers 44 and 45 are drivingly connected to a motor not shown. Between the heating rollers 44 and 45 and the rollers 42 and 43, it is desirable to arrange guide plates 48 and 49 for guiding the recording medium. The heating rollers 44 and 45 may be formed with a metallic cylinder made of, for example, stainless steel or may be formed with an elastic body such as silicon rubber or fluoride rubber.

In a regenerating operation, the recording medium 100 such as paper or OHP transfer layer having thereon the printing material 101 such as the toner is fed into the cleaning chamber 3 through the charge-side opening 6 of cleaning unit 2 by the rotation of the rollers 8. The recording medium 100 is forwarded between the guide plate 19 and the sheet 26 and then immersed in the cleaning liquid 10 so that the printing material 101 is swollen to be readily separable.

The swollen printing material 101 comes into contact with the transferring roller 16 rotating in the direction of the arrow at the sheet opening 29, and is transferred to the circumferential transfer layer 17b of the transferring roller 16. The both sides of the recording medium 100 move while guided by both side portions 30 of the sheet 26 which opposes each other beyond the sheet opening 29. Consequently, the recording medium 100 securely separates from the transferring roller 16 and will never wind around this transferring roller 16.

The printing material 101 transferred to the transfer layer 17b of the transferring roller 16 is conveyed by the rotation of the transferring roller 16 and then removed from the transfer layer 17b by the scraper 34 to be recovered in the recovery vessel 32. In this removing of the printing material, because the circumferential transfer layer 17b of the transferring roller 16 provides excellent separability of the printing material 101, it can be easily removed by the scraper 34.

Then, the recording medium 100, from which the printing material 101 removed, is further conveyed along the guide plate 19, and is squeezed to remove cleaning liquid 10 impregnated in the medium 100 by the squeeze rollers 9. The cleaning liquid squeezed out from the recording medium 100 is received by the recovery plate 11b and recovered into the container 11. On the other hand, the printing material dissolved in the cleaning liquid without transferring to the layer 17b is caught by the filter 14 when it passes the filter 14 together with the cleaning liquid 10 circulated by the pump 13 through the transfer pipe 15. Consequently, the cleaning liquid 10 is kept clean so that it may be used over a long period of time.

The recording medium 100 fed out by the squeeze rollers 9 is then forwarded to the drying unit 36 and introduced into the drying chamber 37 by the rollers 42. The medium 100 is then heated and dried while it is travelling through a nipping region of the rotating heat rollers 44 and 45, and discharged onto the tray not illustrated by the conveyor 43.

In the embodiment previously described, part of the circumferential surface of the transferring roller 16 constantly contacts the cleaning liquid 10. Consequently, the printing material 101 liberated in the cleaning liquid 10 may adhere again to the circumferential surface of the transferring roller 16 in contact with the cleaning liquid. Also, the printing material adhered to the transferring roller 16 may transfer to the recording medium 100 again. Therefore, in this invention, the circumferential surface of the transferring roller 16 is cleaned to remove the transferred printing material 101 when the regenerating device 1 is not in operation.

Figure 5:
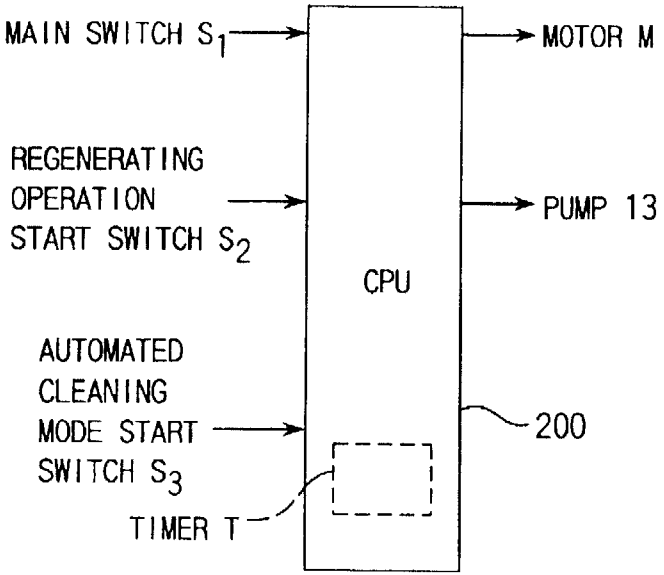
FIG. 5 is a schematic diagram showing the signal entering CPU.

A cleaning process of the transferring roller 16 is discussed in detail hereinafter. This process is executed by a CPU (Central Processing Unit) 200 as shown in FIG. 5, to which a main switch S1 to start the regenerating device 1, a regenerating mode start switch S2, and an automated cleaning start switch S3 are electrically connected. According to the cleaning process, when the main switch S1 is turned on to start the regenerating device 1, a initial cleaning mode starts and then a timer T starts. Next, a driving motor M of the transferring roller 16 and the pump 13 of the circulation unit 12 begin to operate. This condition is kept until the timer T finishes. Therefore, each portion of the circumferential surface of the transferring roller 16 repeatedly contacts the cleaning liquid 10 according to the rotation thereof so that the printing material 101 adhered to the circumferential surface is washed out therefrom. The printing material 101 floating in the cleaning liquid 10 and the printing material 101 thus washed out from the transferring roller 16 is removed at the filter 14 when the cleaning liquid is circulated via the transfer pipe 15. It is not necessary to rotate the transferring roller 16 in the same direction as the regenerating operation, this roller 16 may be rotated in the reverse direction or may be rotated alternately in the normal or reversal direction at specified intervals.

When the main switch S1 is turned on, the regenerating operation which is described above starts by turning on the regenerating operation start switch S2. If, however, the regenerating operation start switch S2 is turned on during the initial regeneration operation being executed, this cleaning mode is executed only after the initial cleaning mode is finished. Upon turning on the switch S2, the recording medium 100 is fed into the cleaning unit 2 where the printing material 101 is washed out therefrom and then dried at the drying unit 36. Also, the circulation unit 12 is operated so that the cleaning liquid 10 is transported through the transfer pipe 15 and the printing material 101 liberated in cleaning liquid 10 is recovered in the filter 14. The regenerating operation is maintained until the recording medium 100 is discharged from the regenerating device 1. In other words, the regenerating operation is finished when the discharging of the recording medium from the regenerating device 1 is detected. This detection is carried out by a sensor disposed at the discharge-side of the drying unit 36 or by a timer. When the regenerating operation is finished, the circulation unit 12, all elements related to conveyance of the recording medium 100, i.e., the rollers 8, 9, 42, and 43, the motor of the transferring roller 16, and the heating rollers 44 and 45 are stopped so that the regenerating device returns to the initial condition.

It is desirable that in a regenerating device which accommodates a plurality of medium 100 and cleans them, the regenerating operation is maintained so that the circulation unit 12 is kept working until a sensor disposed in the vicinity of the rollers 9 detects the rear edge of the last medium.

It is not necessary to operate the circulation unit 12 simultaneous with the transfer roller 16. The circulation unit 12 may start to operate after the media are discharged outside the device so as to suppress power consumption.

Figure 6:
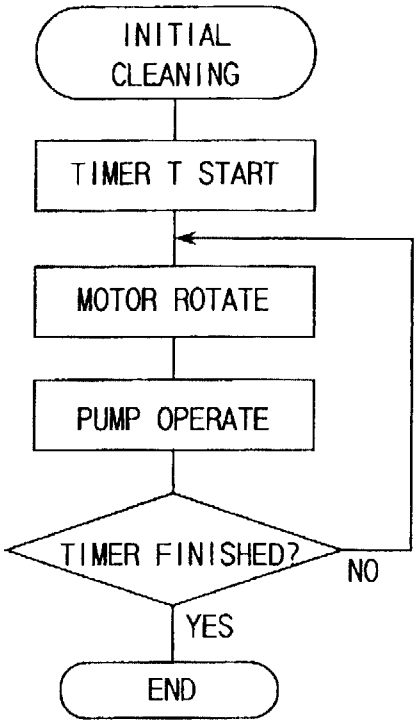
FIG. 6 is a flow chart showing the operation of initial cleaning.

Referring to FIG. 6, the automated cleaning mode will be discussed hereinafter. In this mode, if a switch S3 of the automated cleaning mode is turned on, it is determined whether the regeneration operation has not been executed for a specified time, e.g., 30 minutes or one hour. If it is determined that the regeneration operation has not been carried out at all during the specified time, a timer T starts. Then, the motor M and the pump 13 starts to wash out the printing material 101 adhered to the circumferential surface of the transferring roller 16, while the printing material 101 floating in the cleaning liquid 10 is removed by the filter 14 of the circulation unit 12. Preferably, the timer may be set only once when the specific time has passed from the last regenerating operation so that the automated cleaning mode is not carried out repeatedly unnecessarily even in the case that the regenerating device is not operated for a long time when the main switch is turned on.

According to the cleaning process, when the operator turns on the main switch S1 in the morning to operate the regenerating device 1, the initial cleaning is executed automatically. Consequently, when the operator turns on the regenerating operation start switch S2, the removing operation of the printing material 101 from the printing medium 100 is carried out by using the refreshed transferring roller 16 from which contaminants adhered at night are eliminated, which eventually increases the cleaning efficiency. Also, the cleaning of the removing member and the transferring roller 16 is periodically cleaned in the automatic cleaning mode set by the switch S3 even though the main switch S1 is turned on but the cleaning mode is not set, which ensures a efficient cleaning.

Figure 8:
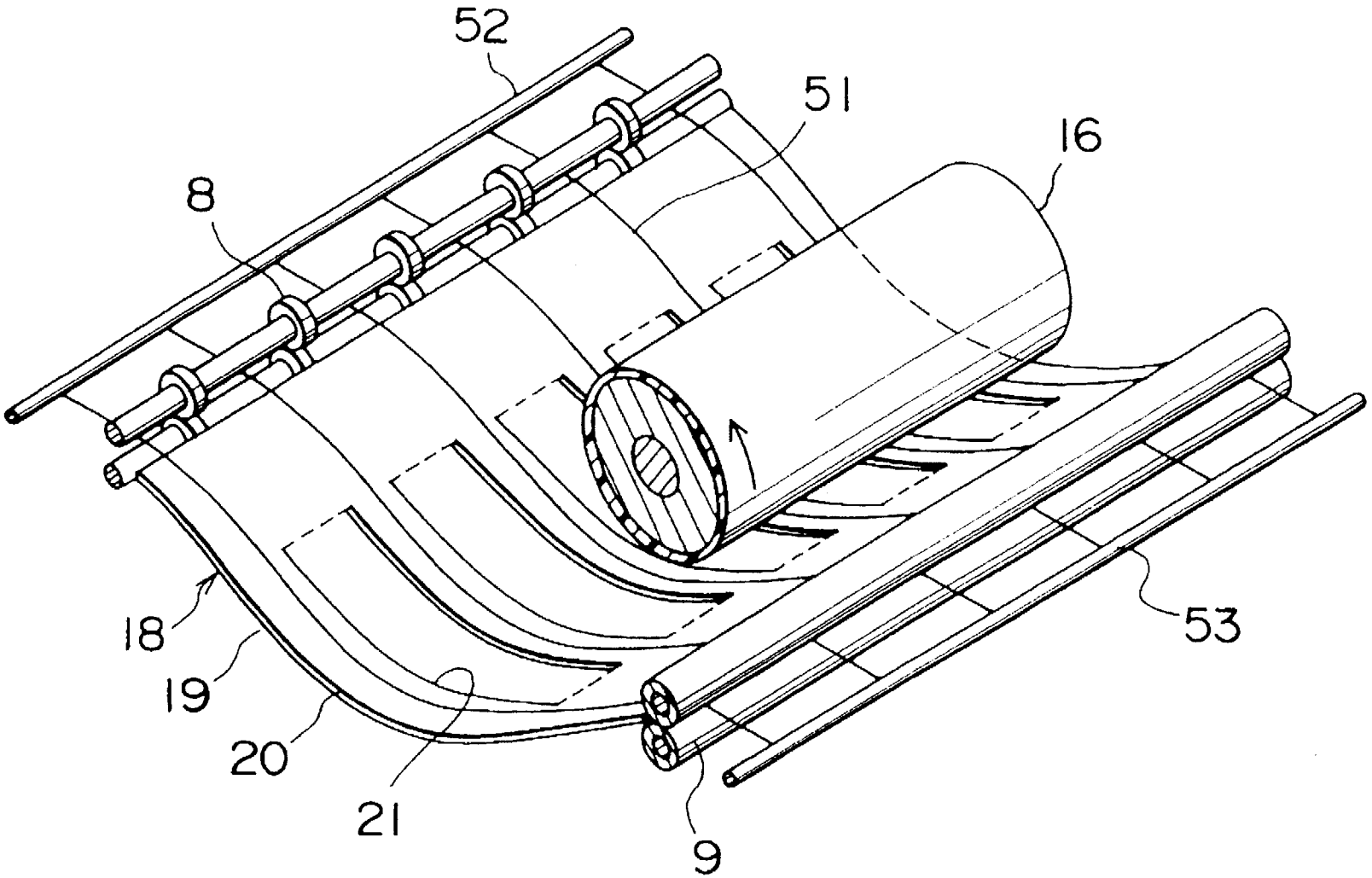
FIG. 8 is a perspective view of the guiding means of another embodiment.

Although in the above embodiment of the invention previously described, a mesh sheet 26 is used as a means for preventing the recording medium 100 from winding, as shown in FIG. 8, this means may be formed with strings 51 consisting of a plurality of wires or synthetic resin threads arranged along the guide plate 19 in the direction of the movement of the recording media and bars 52 and 53 which support the respective edges of the strings.

Further, it is not necessary to use a transferring roller 16 as a transferring member, the transferring member may be at least one of two rollers, i.e., upper and lower rollers, and a belt entrained therearound.

Figure 9:
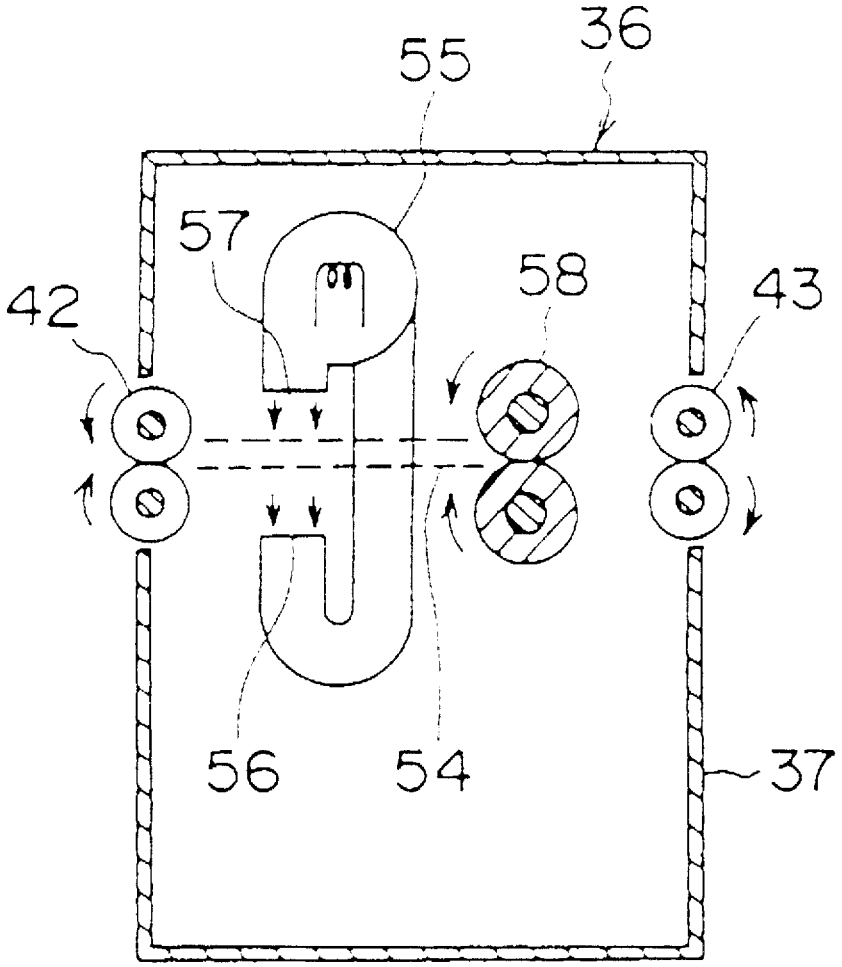
FIG. 9 is a cross sectional view of the dryer of other embodiment.

Furthermore, in another embodiment of the dryer, as shown in FIG. 9, a dryer 36 is equipped with a pair of mesh plates 54 or porous plates and a dryer 55 having a suction hole 56 arranged below the meshes 54 and a hot air outlet 57 arranged above the meshes 54. In this embodiment, on the downstream side of the meshes 54, it is desirable to install a pair of rollers 58 for removing wrinkles of the recording medium 100 dried by the dryer 55.

2. Second Embodiment

Figure 10:
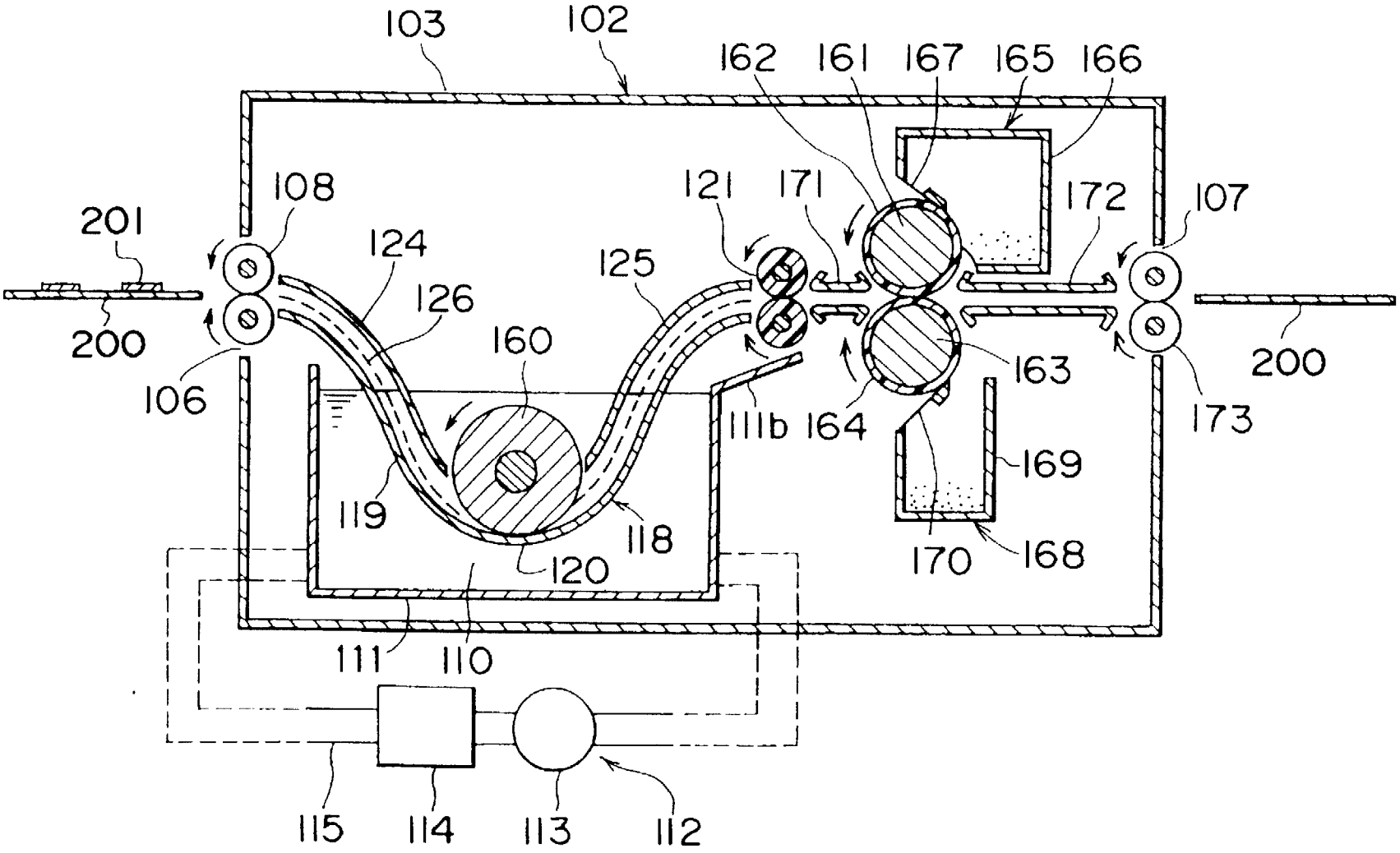
FIG. 10 is a cross sectional view of the cleaner of another embodiment.

FIG. 10 shows a second embodiment of the cleaner in the regenerating device. In this cleaner 102, in the container 111 accommodating the cleaning liquid 110, a cylindrical transfer roller 160 is mounted for rotation in the direction indicated by the arrow by means of a motor not illustrated. The bottom of the transfer roller 160 slightly contacts the central portion 120 of the guide plate 119 bent downwards or faces it with a clearance nearly equivalent to the thickness of the recording medium 200 so that the transfer roller 160 nips the recording medium 200 with the guide plate 119 to forward it.

Transfer rollers 161 and 163 made of elastic material have on circumferential surfaces thereof transfer layers 162 and 164, respectively, having excellent absorbency and separability against the printing material 201. These rollers 161 and 163 are arranged in the downstream region of the squeeze rollers 121 with respect to the movement of the recording medium 200 with one of the rollers 161 being in contact the upper part of the other roller 163, and are drivingly connected to a motor so as to rotate in the arrow directions illustrated, respectively. Heaters may be installed in the rollers 161 and 163 to not only assist absorbency but also thermally assist the adsorption. In this embodiment, it is desirable to heat the rollers to 50°–200° C., preferably, to about 120°–180° C.

Recovery units 165 and 168 are arranged besides the rollers 161 and 163, respectively. These units 165 and 168 comprise respective scrapers 167 and 170 whose tip portions contact the transfer layers 162 and 164, respectively, so as to remove the printing material 201 from the circumferential transfer layers 162 and 164 of the transfer rollers 161 and 163.

Reference numeral 171 indicates a guide plate which guides the recording medium 200 from the squeeze roller 121 to the rollers 161 and 163, and reference numeral 172 indicates a guide plate which guides the recording medium 200 from the rollers 161 and 163 to the rollers 173 disposed in the discharge-side opening 107 of the cleaning chamber 103. Other components which are the same members as that used in the cleaner 2 shown in FIGS. 2 and 3 are given the symbols (numerals) adding 100 to the same symbols (numerals) and the description of such members is omitted.

In operation of this cleaner 102, the recording medium 200 introduced between the guide plate 119 and the sheet 126 by the rollers 108 is immersed in the cleaning liquid 110 to swell the printing material 201. The recording medium 200 moving in the cleaning liquid 110 is further transported towards the downstream side of the cleaner 102 by the rotation of the transfer roller 160, and when it is discharged (removed) from the cleaning liquid 110, the cleaning liquid 110 is squeezed out therefrom with the squeeze roller 121. The squeezed excess cleaning liquid 110 is caught by the recovery plate **111*b* of the container 111 and recovered. The recording medium 200 passed through a nipping region of the squeeze rollers 121 is forwarded along the guide plates 171 to the nipping region of the transfer rollers 161 and 163 where the printing material 201 on the top and bottom surfaces is removed by the circumferential transfer layers 162 and 164. The printing materials 201 transferred to the transfer layers 162 and 164 are scraped by the scrapers 167 and 170, respectively, and recovered in the containers 166 and 169. Then, the recording medium 200 is transported along the guide plates 172 and is then fed into the dryer (not illustrated) by the rollers 173**.

3. Third Embodiment

Figure 11:
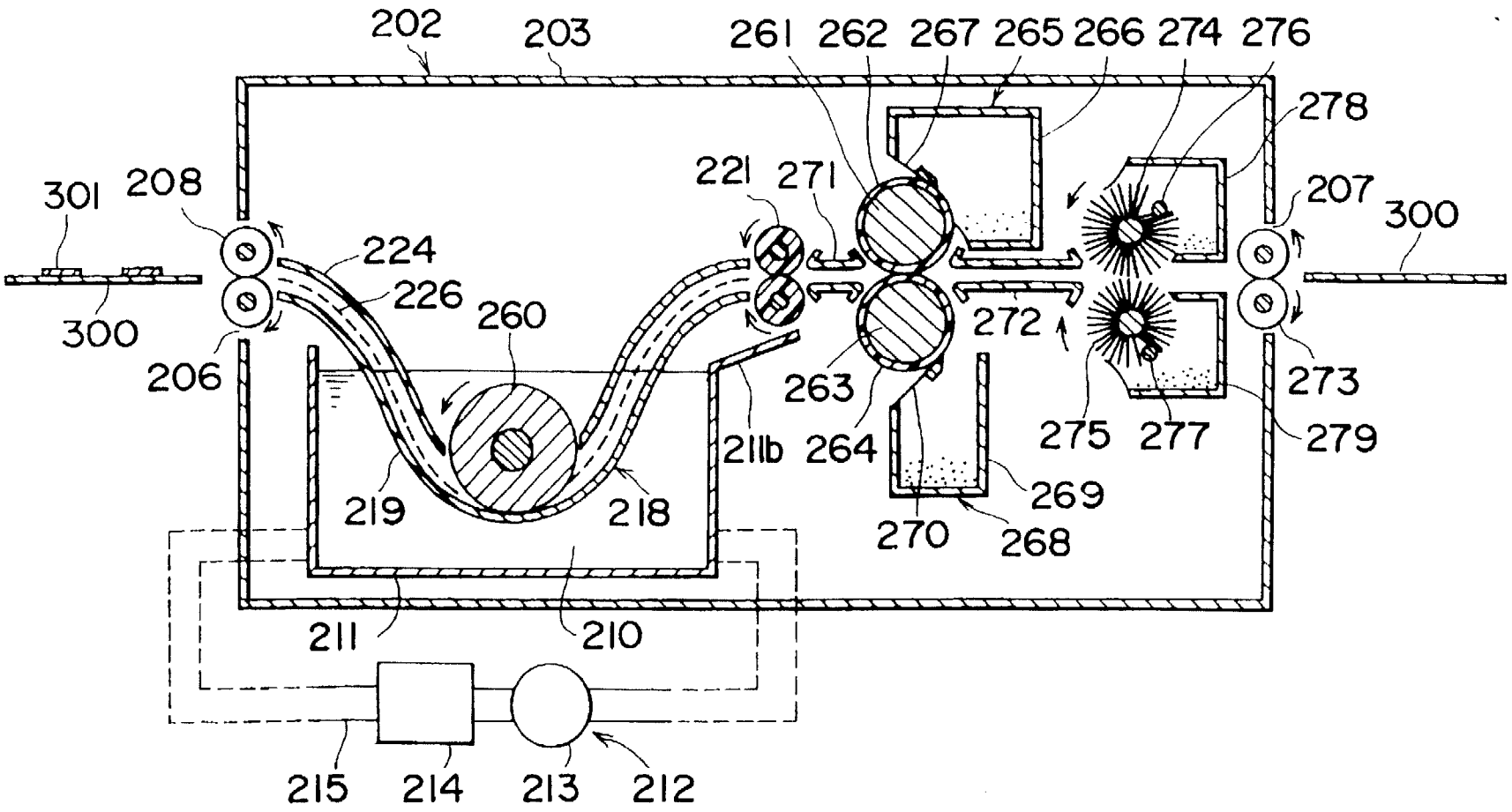
FIG. 11 is a cross sectional view showing a modification example of the cleaner.

FIG. 11 shows a third embodiment of the cleaner. In this embodiment, a pair of brush rollers 274 and 275 are mounted for rotation in the direction indicated by arrows between the transfer rollers 261 and 263 and the discharging rollers 273. These brush rollers 274 and 275 are arranged to oppose beyond a passage of the recording medium but slightly contact each other. Other components which are the same members as that used in the cleaner shown in FIG. 10 are given the symbols (numerals) adding 100 to the same symbols (numerals) and the description of such members is omitted.

In operation, the recording medium 300 which has passed through the nipping region of the transferring rollers 261 and 263 is brought into contact with the brush rollers 274 and 275 so that the residual printing material 301 on the recording medium 300 is removed therefrom. The printing material 301 caught by the brush rollers 274 and 275 drops into the recovery containers 278 and 279, respectively, by oscillation generated when these brush rollers 274 and 275 engage with respective rods 276 and 277.

4. Fourth Embodiment

Figure 12:
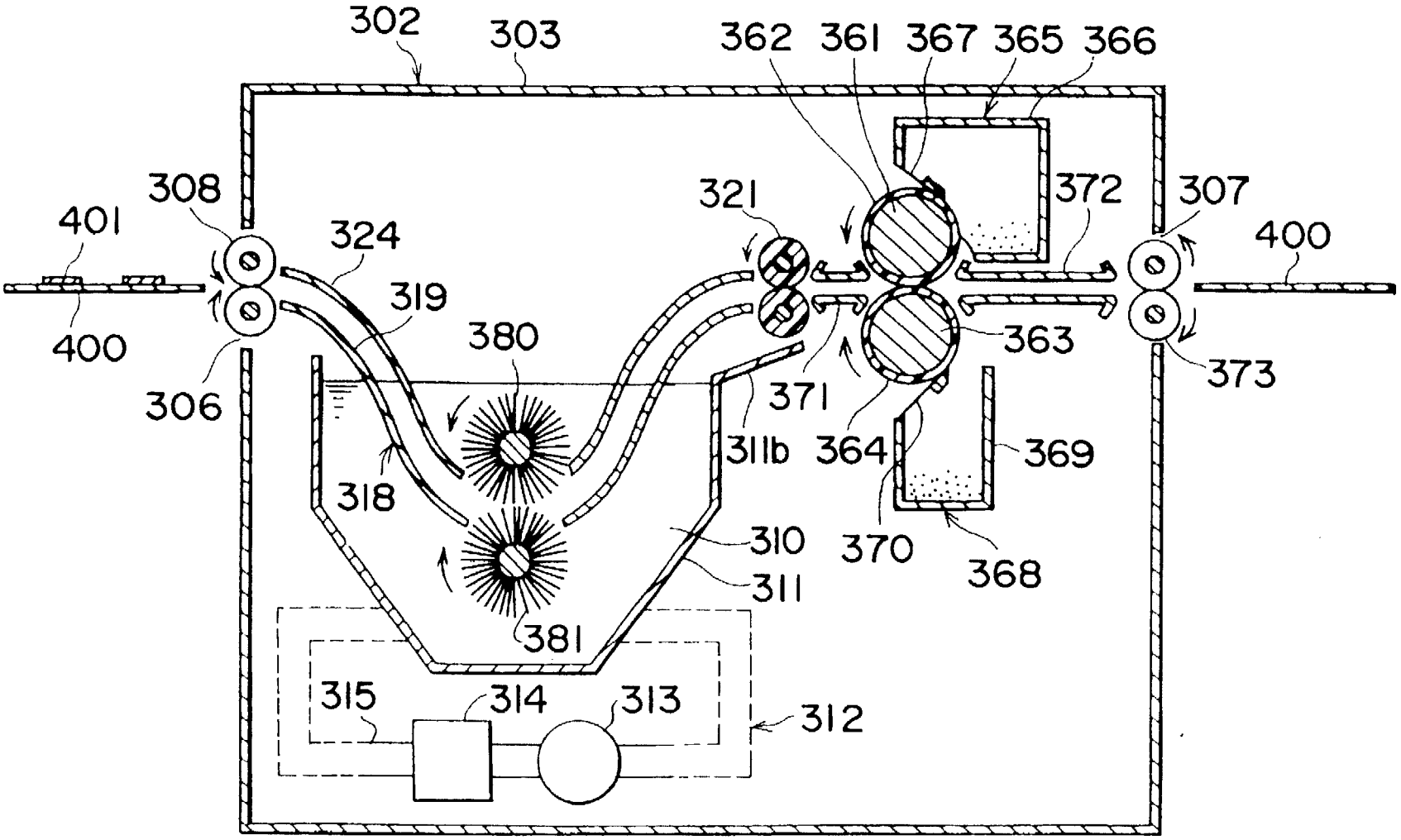
FIG. 12 is a cross sectional view showing another modification example of the cleaner.

FIG. 12 shows a fourth embodiment of the cleaner. In this embodiment, as a means for transporting the recording medium 400 in the cleaning liquid 310, a pair of upper and lower brush rollers 380 and 381 are used. Other components which are the same members as that used in the cleaner shown in FIG. 10 are given the symbols (numerals) adding 200 to the same symbols (numerals) and the description of such members is omitted.

In this cleaner, the recording medium 400 in the cleaning liquid 310 is transported by forces provided by the brush rollers 380 and 381 whose brushes are brought into contact with the top and bottom surfaces of the recording medium 400. In this process, a significant portion of the printing material is removed by the brush rollers 380 and 381, and then, residual printing material is completely removed by the adhesion to the circumferential transfer layers 362 and 364 of the transferring rollers 361 and 363. According to this embodiment, the recording medium 400 will never wind around the brush roller 380 or 381, and it is not necessary to install a sheet for preventing the medium from winding between the guide plates 319 and 324.

It is preferable to provide the cleaners in the second, third, and fourth embodiments with a cleaning member so that printing material adhered to the roller and brush rollers and are washed out by rotating these rollers for a specified time at the beginning of the regenerating operation or in the non-operating state of the regenerating device. In this operation, it is preferable to drive the circulating device 112 simultaneously. In the cleaner of the fourth embodiment, it is preferable to design the brush rollers 380, 381 to rotate in the same direction and the tip end of each brush to collide against each other.

The circumferential transfer layer of the transfer roller will be discussed in detail hereinafter. For the material of the layers of the transfer rollers, at least one material selected from polyolefin based resin, polyester based resin, nitrogen based resin, sulfur based resin, fluorine based resin, silicone based resin, polyacetal based resin, epoxy based resin, polyether ether ketone based resin, and phenol based resin is used. " . . . based resin" means a polymer, copolymer, mixture containing a resin monomer.

Examples of the polyolefin based resin include polyethylene, polypropylene, ethylene-vinyl alcohol-copolymer, ethylene-propylene-diene ternary coplymer, and poly-4-methyl-penten-1. Examples of polyester based resin include vinyl ester resin, polyarylate, oxy-benzoyl polyester, diarylphthalate resin, polyethylene telephthalate, and polycarbonate. Examples of nitrogen based resin include polyamide, polyparabanic acid, bismalade-triazine, polyetherimide resin, and guanamine resin. Examples of sulfur based resin include polyphenylene sulfide and polysulfone. Examples of fluorine based resin include tetrafluoride resin and poly vinylidene fluoride. Examples of silicone based resin include silicon resin, examples of polyacetal based resin include polyacetal, examples of epoxy resin include epoxy resin, examples of polyether ether ketone based resin include polyether ether ketone, and examples of phenol based resin include phenol resin.

These resins have the composition selected based on the results of the research made whole-heartedly by the inventors from the viewpoint of simultaneously satisfying two different properties: one to adsorb the toner resin later discussed which is presently used and swollen by the cleaning liquid and the other to separate the adsorbed swollen substance by the physical force without chemically fusing to the material of the circumferential transfer layer. When heaters are incorporated in the cylindrical body of the transfer rollers, the composition with excellent heat resistance is preferable. From this viewpoint, polyolefin based resin such as polyethylene, polypropylene, etc. and sulfur based resin such as polyphenylene sulfide resin, etc. are suitable.

When the body of the transfer roller is formed with a rigid body and cleaning is carried out under strong pressure, the composition with excellent strength is desirable. From this viewpoint, nitrogen based resin such as polyamide resin, etc. is desirable. In the toner, various additives are contained, and even if the cleaning liquid itself is neutral, these additives are swollen with the cleaning liquid and may sometimes exhibit acidic or alkaline properties. For example, carbon black which is popularly used as a colorant for the toner generally exhibits strong acidity. Consequently, for the transfer layer material of the present invention, the solvent resistance is required, and from this point of view, polyolefin based resin such as polyethylene, polypropylene, etc. and sulfur based resin such as polyphenylene sulfide resin are suitable. In this invention, these resins may be built into transfer rollers by injection-molding these resins themselves, but it is desirable to have them in the form of transfer layer located on the body of the transfer roller formed with a suitable elastic body or rigid body as described in each embodiment described above. When the body of the transfer roller is formed with an elastic body, it is desirable from the viewpoint of improved adhesion with the printing material and increased absorbency of the printing material such as a toner which is swollen with the cleaning liquid, but there is a fear of producing more wrinkles when the recording medium is paper unless the conveyance accuracy is improved.

When the rigid body is used as a body of the transfer roller, capabilities to adsorb the printing material printed deep in the recording medium (for example, the printing material printed deep in the network structure of paper) might be slightly lowered than those when built with an elastic body, but high pressure can be applied because of the rigid body, producing side effects to stretch wrinkles of paper together with cleaning effects when the recording medium is paper. For an elastic body that can be used as a body of the transfer roller, there is no limitation if the composition is difficult to be subject to the cleaning liquid, but fluorine based rubber, silicone based rubber, polyurethane based rubber, etc. can be enumerated. For the rigid body, if the cleaning liquid is based on water, stainless steel, aluminum, etc. are desirable. In this invention, as a method to bring the above resins in close contact with the body of the transfer roller, a method to form the above resins into heat-shrinkable tubes and to heat them after fitting them over the body of the transfer roller can be employed. As described above, if no body of the transfer roller is used, a method to form the above resins into rolls or transfer layers by injection molding, etc. can be applied.

The cleaning liquid will be described in detail. When the printed portion is removed without pulping the paper, extremely poor print removal effects are achieved by applying the surfactant alone directly on the recording medium, and a substance that swells the toner is used together with the surfactant to allow the toner to come up from the paper surface. Consequently, it is desirable to use the cleaning liquid that contains at least higher fatty acid ester, surfactant which has a compatibility with water and swells the printing material, and water. Water works to swell pulp fibers of the paper and efficiently remove the printing material, such as toner comprising resin particles which penetrate into the network structure. The water content is 10–90 wt % with respect to the total cleaning liquid, preferably, 20–88 wt %. However, when the water content is less than 1 wt %, there is a case in which effects to expand the fiber are not sufficient. Conversely, when the water content is excessively large, time required for cleaning greatly increases, lowering the cleaning treatment efficiency per unit time. Though it depends on the toner type, when water exceeds 90 wt %, the said time excessively increases and it is not desirable. If the water content is great as seen in this case, the bonding force (hydrogen bond) between fibers is weakened, damaging the paper surface during cleaning with physical force applied and in the extreme case, resulting in breaking the paper fiber to destroy the paper. It is, therefore, desirable to keep the water content to 30–85 wt %. When the cleaning liquid contains water, the boiling point rises as compared to that of the conventional organic solvent-based ink removing agent and volatility improves. With this effect, toxic gas generation decreases, toxicity lowers, inflammability lowers, stable concentration of other components of the cleaning liquid is achieved, and the quality is difficult to change.

For the swelling agent contained in the cleaning liquid, it is basically desired to have components that scarcely dissolve the resin component of the toner used in a developing device of an image forming apparatus, dye component of the charge controlling agent, etc., and colorant component of pigments, etc., but primarily swell the resin component and convert the toner into gel-form plastic polymers. That is, the regenerating apparatus according to this invention is assumed to be subjected to the largest cleaning volume of the recording medium prepared in the copier to which the regenerating apparatus is to be mounted. For the specific component, it is desirable to include those containing at least higher fatty acid ester, water, and surfactant, and in addition, organic acid.

Next discussion is made on the operation of this component. When the printed recording medium M is immersed in the cleaning liquid, the resin component of the toner fixed on the paper or OHP transfer layer adsorbs the swelling agent by the action of the said swelling agent and converts to viscous gel-form polymer with high plasticity which can stretch from 0.5 mm to several cm. This viscous gel-form polymer greatly lowers the bonding force to paper fibers or OHP transfer layer and is readily liberated by applying only a slight physical (mechanical) stress, and cleaning takes place. The cleaning action depends on the pH of the liquid and in particular, when the toner resin is polyester-based, bringing the liquid pH to weak alkaline of about 8–10 breaks the ester bonding to decompose into fine powders, enabling further easier removal. In addition, the cleaning action depends on the liquid temperature. Consequently, the liquid pH and temperature shall be determined based on these, but it is desirable to adjust the pH to 3.0–11.0 and liquid temperature in the range of 20°–60° C. In order to achieve stable cleaning effects, it is more desirable to use various pH buffers to keep the pH to an optimum constant value. Under the weak acidic condition with pH less than 3.0 or strong alkaline condition with pH exceeding 11.0, swelling action of toner resin by the swelling agent and peeling action are lowered. At the liquid temperature lower than 20° C., the speed of swelling action of the swelling agent lowers and it becomes difficult to achieve sufficient practical cleaning efficiency. In addition, when the liquid temperature exceeds 60° C., transpiration of the liquid is accelerated and heating power increases excessively, resulting in poor economy.

The fatty acid of the suitable higher fatty acid ester as a swelling agent must be saturated or unsaturated fatty acids and examples include lauric acid, myristic acid, palmitic acid, stearic acid, oleic acid, linoleic acid, erucic acid, ricinoleic acid, abietic acid, rosin, coconut oil, linseed oil, beef tallow, whale oil, etc. Higher fatty acid ester is ester of the fatty acid and hydroxy compounds, examples of which include alcohols such as ethanol, n-butanol, etc., polyhydric alcohols such as ethylene glycol, glycerin pentaerythritol sorbitol, glycols such as diethylene glycol, dipropylene glycol, polyethylene glycol, etc., and cellosolves such as ethyl cellosolve, butyl cellosolve, etc., but particularly tall oil fatty acid ester is desirable.

Tall oil fatty acid contains oleic acid and linoleic acid at a ratio of about 6 to 4, as well as traces of palmitic acid, stearic acid, and unsaponifiable matter. Examples of alcohols which esterify tall oil fatty acid include ethylene glycol, polyethylene glycol, ethoxyethanol, butoxyethanol, etc., and preferably, butoxyethanol, ethylene glycol, and ethoxyethanol are used. The cleaning liquid of this invention preferably includes the surfactant. The surfactant serves to surround the organic component printing material such as cleaned resin component and prevents the cleaned printing material from re-adhering to the recording medium. When the recording medium is paper such as plain paper, the surfactant penetrates in the paper network structure to surround the printing material so that the printing material entering deep in the fiber is easily cleaned.

Examples of surfactants which are preferably added include anionic surfactant, nonionic surfactant, cationic surfactant, amphoteric surfactant, etc. Examples of anionic surfactants include fatty acid salts, alkylsulfate ester salts, alkyl benzensulfonic acid salts, alkyl naphthalene sufonates, alkyl suofosuccinic acid salts, alkyl diphenyl ether disulfonates, alkyl phosphates, polyoxyethylene alkylsulfate ester salts, naphthalene sulfonic acid formalin condensation products, poly carboxylic acid polymer surfactants, etc.

Examples of nonionic surfactants include polyoxyethylene alkylether, polyoxyethylene alkyl arylether, oxyethylene-oxypropylene copolymer, sorbitan fatty acid ester, polyoxyethylene sorbitan fatty acid ester, polyoxyethylene fatty acid ester, glycerol fatty acid ester, polyoxyethylene alkylamine, etc.

Examples of cationic and amphoteric surfactants include alkyl amine salts, quaternary ammonium salts, alkyl betaine, amine oxides, etc. Particularly preferable surfactants are ethylene oxide added type nonionic surfactants, which are expressed with the chemical formula: $RO(CH_2CH_2O)nH$ (R denotes $C_{12}$–$C_{22}$ alkyl group or alkyl phenyl group and n an integer of 1–10). The above surfactants can be used alone or as a mixture of two or more types. It is desirable to add 0.01–10 wt % (preferably, about 1–3 wt %) to the whole cleaning liquid. If it is less than 0.01 wt %, the removed toner is likely to re-adhere to the recording medium. If it is more than 10 wt %, bubbles are generated and it becomes difficult to handle.

The cleaning liquid preferably contains organic acid and must penetrate the printing material. The inventors of the present invention have found that the organic acid improves these penetration effects. Improved penetration effects can shorten the cleaning time. The organic acids preferably added are various carboxylic acids, such as simple substance or mixture of two or more types of formic acid, acetic acid, propionic acid, butyric acid, isobutyric acid, pivalic acid, methacrylic acid, acrylic acid, lactic acid, oxalic acid, tartaric acid, benzoic acid, etc. These organic acids are preferably added by 2–15 wt % to the whole cleaning liquid. If the content is less than 2 wt %, the ink removal speed may be slow and if it is more than 15 wt %, the remaining organic acid may work on the recording medium, causing deterioration in quality.

In the cleaning liquid, higher fatty acid ester should be used in the range of 60–5 wt %, preferably 40–20 wt % of the total cleaning liquid. If it is used more than 60 wt %, the solubility to the toner is high and it is likely to re-adhere to the paper, while if it is used in the range less than 5 wt %, the swellability to the toner degrades, resulting in poor cleaning effects.

The cleaning liquid may contain, within the range that would not impair the effects of the present invention, the organic solvent for swelling the toner, such as methanol, ethanol, n-butanol, isopropanol, ethoxyethanol, etc. and a mixture of these with xylene, toluene, acetone, THF, dioxane, dichloromethane, etc. Such cleaning liquid is commercially available from Nagamune Sangyo as TOSCLEAN D. TOSCLEAN D is a water-based detergent and is a light yellow transparent liquid with physical properties of acid number: about 2.1 mgKOH/g, specific gravity: 1.020 (20° C.), and pH: 7±0.5 (15° C.). This cleaning liquid does not contain any fluorine or carbon chloride compounds which are condemned for destroying the ozone layer, and can be used without deteriorating the earth environment. In addition, because it causes low toxicity to the human body and is nonflammable (no flash point), it is extremely suited for application to a paper regenerating apparatus in the regular office environment as in the case of this invention.

The recording medium subjected to the cleaning liquid is not particularly limited, but marked cleaning effects are obtained with plain paper or recycled paper with the network structure which has been difficult for cleaning as discussed above as well as with resin transfer layers (OHP form). Similarly, the printing material subjected to the cleaning liquid of the present invention may be water-soluble and oil-soluble inks and red seal-ink, or felt-pen markers, and are not particularly limited, but it exhibits excellent cleaning effects for toner particles including resin components which are believed to be particularly difficult to clean.

Now a description is made of the toner used in the developing device. Examples of the resin component to be used include thermoplastic resins or thermosetting resins such as styrene resin, acrylic resin, methacrylic resin, styrene-acrylic copolymerized resin, styrene-butadiene copolymerized resin, polyester resin, epoxy resin, etc. Or copolymers, block polymers, and graft polymers comprising two or more types of these resins or mixtures of these resins may be used. In these resins, it is preferable to use resins whose number average molecular weight Mn is $1000 \leqq Mn \leqq 20000$, more preferably, $2000 \leqq Mn \leqq 15000$ and weight average molecular weight Mw is $2 \leqq Mw \leqq 80$. It is preferable to use the resin whose glass transition temperature is from 55° to 70° C. and softening point is from 80° to 140° C.

For the colorant, various publicly known pigments and dyes can be used. However, if dyes are used as a colorant, dyes are dissolved in the ink removing agent and re-adhere to the recording medium, possibly reducing the cleaning effects. This kind of inconvenience does not give rise to problems when resin transfer layers are used, but when paper with the network structure is used, the pulp fiber of the paper is dyed, creating a serious problem. Consequently, for the colorant of the toner used in the developing device, pigments should be used to prevent the colorant from dissolving during cleaning. Examples of the colorants include carbon black, copper oxide, manganese dioxide, aniline black, activated coal, ferrite, magnetite, etc. for black pigment.

Examples of the yellow pigment include chrome yellow, zinc yellow, cadmium yellow, yellow iron oxide, mineral fast yellow, nickel titanium yellow, navel yellow, naphthol yellow S, Hansa yellow G, Hansa yellow 10G, bendizine yellow-G, bendizine yellow-GR, quinoline yellow lake, permanent yellow NCG, Tartrazine lake, etc.

Examples of the red pigment include red chrome yellow, Molybdenum Orange, Permanent Orange GTR, Pirazolone Orange, Vulcanized Orange, Indanthrene Brilliant Orange RK, Bendizine Orange G, Indanthrene Brilliant Orange GK, red ion oxide, cadmium red, red lead, permanent red 4R, lithol red, pyrazolone red, watching red, lake red C, lake red D, brilliant carmine 6B, eosin lake, rhodamine lake B, alizarin lake, brilliant carmine 3B, vulcanized fast orange GG, permanent red FR4H, permanent carmine FB, etc.

Examples of the blue pigment include iron blue, cobalt blue, alkali blue lake, victoria blue lake, phthalocyanine blue, etc. It is desirable to add 1 to 20 parts by weight of these pigments or colorants, preferably 3 to 15 parts by weight with respect to 100 parts by weight of resin component in the toner.

The toner may contain a charge controlling agent. For the positive charge controlling agent that charges the toner positively, nigrosine base EX, quaternary ammonium salt, polyamine compound, imidasol compound, etc. may be used. For the negative charge controlling agent that charges the toner negatively, chromium complex salt type azo dyes, copper phthalocyanine dyes, chromium complex salts, zinc complex salts, aluminum complex salts, etc. may be used.

It is preferable to add 0.1 to 10 parts by weight, preferably 0.5 to 5 parts by weight of these charge controlling agent with respect to 100 parts by weight of the resin component in the toner. Various types of the above-mentioned charge controlling agents may be used. However, if dye-based charge controlling agents are used, as described in the case of the colorant, dyes may dissolve in the cleaning liquid, re-adhere to the recording medium, and reduce cleaning effects. Consequently, it is desirable to use non-dye based charge controlling agent for the toner to be cleaned or to design to eliminate all charge controlling agents. Or, it is desirable to use charge controlling agents which may be colorless or white even when they dissolve. Or, it is desirable to design the toner resin that has a polar group or functional group and as a charge control resin in which the resin component itself possesses the charge control capabilities.

The toner may contain the offset preventing agent. For the offset preventing agent, low molecular weight polyethylene wax, low molecular weight oxygen convertible polyethylene wax, low molecular weight polypropylene wax, low molecular weight oxygen convertible polypropylene wax, higher fatty acid wax, higher fatty ester wax, sazole wax, etc. may be used alone or as a mixture of two or more types. It is desirable to add 1 to 15 parts by weight, preferably, 2 to 8 parts by weight of these offset preventing agent with respect to 100 parts of resin components in the toner. The toner according to this invention may be designed to be a magnetic toner. The magnetic toner is formed by adding metals exhibiting magnetism such as cobalt, iron, nickel, aluminum, lead, magnesium, zinc, antimony, beryllium, Bismuth, cadmium, calcium, manganese, selenium, titanium, tungsten, banadium, etc., oxides and sinters of these metals, alloys comprised of two or more types of these metals, or mixtures comprised of these metals, oxides, sinters, alloys, etc.

It is desirable to add 1 to 80 parts by weight, preferably, 5 to 60 parts by weight of these magnetic substances with respect to 100 parts by weight of the resin components in the toner. The toner according to this invention may contain a superplasticizer. Examples of the superplasticizer include silica fines, titanium oxide fines, alumina fines, magnesium fluoride fines, silicone carbide fines, boron carbide fines, titanium carbide fines, zirconium carbide fines, titanium nitride fines, zirconium nitride fines, magnetite fines, molybdenum disulfate fines, aluminum stearate fines, magnesium stearate fines, zinc stearate fines, and other various inorganic material fines. These inorganic material fines are desirable to be treated to be hydrophobic with the silane coupling agent, titanium coupling agent, higher fatty acid, or silicon oil.

It is also possible to use various organic materials such as styrene base, acrylic base, methacrylic base, benzo guanamine, silicone, Teflon, polyethylene, polypropylene, etc. which are granulated by the wet polymerization such as emulsion polymerization, soap-free emulsion polymerization, nonaqueous dispersion polymerization, etc. or vapor phase method. They can also be used in combination with the above-mentioned nonorganic material fines. It is desirable to add 0.05 to 5 parts by weight, preferably 0.1 to 3 parts by weight of these superplasticizers with respect to 100 parts by weight of the resin component in the toner.

Now, experimental examples with specifically varying compositions of the transfer layer and body of the transfer roller are shown hereinafter. The compositions used are as shown in Table 1. Experimental examples 1–3 show the cases in which heat-shrinkable tubes consisting of the resins specified in each experimental example were fitted over the body of the transfer roller and heated to 200°–300° C. to form an integrated roller shape. The diameter of the body of the transfer roller was about 40 mm, transfer layer thickness was about 2 mm in all experimental examples. On the other hand, experimental examples 4–10 show the cases in which cylindrical roller about 3 mm thick was formed by injection-molding the resins listed in Table 1 and in experimental example 11, aluminum was used for the body of the transfer roller. The regenerating apparatus used for experiments was that explained in FIG. 10. For the recording medium, "A4" writing plain paper size weighing 64 g/m$^2$ was used and a test chart with 7% letters filled was cleaned with the following toner and cleaning liquid. The travelling speed of the plain paper in the equipment was 20 mm/sec and rotating speeds and other conditions of the body of the transfer roller were adjusted accordingly. The swollen toner was separated from transfer layers with polyimide scrapers.

The toner used for this experiment was obtained by mixing the following materials with a Henshel mixer, blending them with a twin-screw extruder, and cooling. One hundred parts by weight of polyester resin (Mn: 4500, Mw: 158000, Tg: 66° C., Tm: 118° C.) are combined with 10 parts by weight of carbon black (commercially available from Cabolac as Mogull), 3 parts by weight of offset preventing agent (commercially available from Sanyo Chemical Industries Ltd. as BISCOL Ts200), and 3 parts by weight of charge controlling agent (commercially available from Orient Kogyo as BONTRON E-84), and then cooled. The mixture was coarsely ground, then finely ground with a jet grinder, and treated with an air classifier to have a toner of 8.3 μm in volume mean grain size.

The cleaning liquid used in this experiment consists of the following components. Twenty-five parts by weight of fat acid ester (tall oil fat acid ester) were combined with 50 parts by weight of water (ion exchange water), 2 parts by weight of surfactant (dialkyl sodium sulfosuccinate), and 18 parts by weight of organic solvent ($CH_4H_9OCH_2CH_2OH$).

Table 1 shows the results of Experiments 1–11. In Table 1 "◎" marked for absorbency indicates that the toner is thoroughly adsorbed by the transfer layer after 100 sheets of paper are treated. "○" indicates that the absorbing capability slightly lowers. "x" indicates that the toner is difficult to be adsorbed. "◎" marked for separability indicates that the toner is thoroughly adsorbed by the transfer layer after 100 sheets of paper are treated and the adsorbed toner is nearly completely separated by the scraper and "○" indicates that slight contamination is found in the transfer layer. On the other hand, "x" indicates that the toner is fused and is difficult to be separated. Experimental results shown in Table 1 indicate that the particularly preferable types of resins of those related to the present invention are polyolefin based resin and polyacetal based resin.

Although the present invention has been fuly described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

| Experiment | Base substrate | Transfer layer: type of resin, commercial name | Absorbency | Separability |
|---|---|---|---|---|
| 1 | Polyurethane rubber | Polyolefin based resin (polyethylene), SUMITUBE W, Sumitomo Electric | ◎ | ◎ |
| 2 | Polyurethane rubber | Silicone based resin, SF400DG, Araki Rubber | ○ | ◎ |
| 3 | Polyurethane rubber | Fluorine based resin (Teflon), A31-5-00, Araki Rubber | ○ | ◎ |
| 4 | Polyurethane rubber | Polyolefin based resin (polyethylene), SUNROYD SUNFLIC, Tsutsunaka Plastic Kogyo | ◎ | ○ |
| 5 | Polyurethane rubber | Polyester based resin, ECONOL, Sumitomo Chemical | ○ | ○ |
| 6 | Polyurethane rubber | Polyester based resin (polycarbonate), MACRORON, Bayern | ○ | ○ |
| 7 | Polyurethane rubber | 2Nitrogen based resin (polyamide), DURETAN, Bayern | ○ | ○ |
| 8 | Polyurethane rubber | Sulfur based resin, PPS, Idemitsu Kosan | ○ | ○ |
| 9 | Polyurethane rubber | Fluorine based resin, KURANFLON FX, Kurabo Industries | ○ | ○ |
| 10 | Polyurethane rubber | Polyacetal based resin, TENAC, Asahi Chemical Industry | ◎ | ◎ |
| 11 | Aluminum | Polyacetal based resin, TENAC, Asahi Chemical Industry | ○ | X |

What is claimed is:

1. A regenerating apparatus for removing a printing material from a recording medium so as to reuse the recording medium, comprising:

(a) a container for accommodating a liquid for swelling the printing material;

(b) a guide member for guiding the recording medium, part of which is arranged in the liquid;

(c) a rotatable transporting roller for transporting the recording medium along the guide member, so that the printing material on the recording medium is immersed in the liquid;

(d) a rotatable transferring roller disposed near the guide member so as to be in contact at a circumferential surface thereof with the recording medium and receive the printing material swollen by the liquid from the recording medium; and (e) a scraper which contacts the surface of the transferring roller to remove the printing material therefrom;

(f) wherein the surface of the transferring roller is formed with at least one of the materials selected from polyolefin resin, polyester resin, nitrogen containing resin, sulfur containing resin, fluororesin, silicon resin, polyacetal resin, epoxy resin, polyether ether ketone resin, and phenol resin; and (g) wherein the transferring roller is so arranged as to contact the recording medium removed from the liquid.

2. A regenerating apparatus for removing a printing material from a recording medium so as to reuse the recording medium, comprising:

(a) a container for accommodating a liquid for swelling the printing material;

(b) an applying means for applying the liquid to a recording medium having the printing material;

(c) a transferring means for contacting the recording medium and receiving the printing material swollen by the liquid applied thereto from the recording medium; and (d) a recovering means for recovering the printing material transferred to the transferring means, (e) wherein a portion of the transferring means to be in contact with the printing material on the recording medium is formed with at least one of the materials selected from polyolefin resin, polyester resin, nitrogen containing resin, sulfur containing resin, fluororesin, silicon resin, polyacetal resin, epoxy resin, polyether ether ketone resin, and phenol resin; and (f) wherein the transferring means is so arranged as to contact the recording medium removed from the liquid.

3. A regenerating apparatus for removing a printing material from a recording medium so as to reuse the recording medium, comprising:

(a) a container for accommodating a liquid for swelling the printing material;

(b) a guide member for guiding the recording medium, part of which is arranged in the liquid;

(c) a transporting means for transporting the recording medium along the guide member;

(d) a removing means disposed near the guide member to remove the printing material from the recording medium;

(e) a cleaning means for removing the printing material retained by the removing means therefrom;

(f) a first switch for starting the cleaning means;

(g) a second switch for starting the transporting means, the removing means, and the cleaning means; and (h) a controller for automatically driving the cleaning means when the first switch is turned on regardless of an instruction of the second switch.

4. A regenerating apparatus as claimed in claim 3 wherein the cleaning means includes a circulating passage for circulating the liquid in the container.

5. A regenerating apparatus for removing a printing material from a recording medium so as to reuse the recording medium, comprising:

(a) a container for accommodating a liquid for swelling the printing material;

(b) a guide member defining a passage for guiding the recording medium, part of which is arranged in the liquid;

(c) a transporting means for transporting the recording medium along the guide member;

(d) a removing means disposed near the passage to remove the printing material from the recording medium;

(e) a cleaning means for removing the printing material retained to the removing means therefrom;

(f) a switch for instructing a starting of a regenerating operation against the recording medium using the transporting means;

(g) a timer for counting time passed from a regeneration operation previously executed; and (h) a controller for driving the cleaning means prior to the regenerating operation provided that the counted time of the timer is greater than a predetermined time when the switch is turned on.

6. A regenerating apparatus as claimed in claim 5 further includes a circulating passage for circulating the liquid in the container.

7. A regenerating apparatus for removing a printing material from a recording medium so as to reuse the recording medium, comprising:

(a) a container for accommodating a liquid for swelling the printing material;

(b) a guide member defining a passage for guiding the recording medium, part of which is arranged in the liquid;

(c) a transporting means for transporting the recording medium along the guide member;

(d) a removing means disposed near the passage to remove the printing material from the recording medium;

(e) a cleaning means for removing the printing material retained to the removing means therefrom;

(f) a switch for instructing a starting of a regenerating operation against the recording medium using the transporting means; and (g) a controller for prohibiting the starting of the regenerating operation based on an instruction of the switch when the cleaning means is in operation.

8. A regenerating apparatus as claimed in claim 7 wherein the cleaning means includes a circulating passage for circulating the liquid in the container.

9. A regenerating apparatus for removing a printing material from a media comprising:

a transferring member;

supplying means for supplying cleaning material to the surface of the transferring member;

means for transporting a medium on which printing material is printed to the transferring member so as to keep the medium in contact with the transferring member, wherein the surface of the transferring member is formed with at least one material selected from the group consisting of polyolefin resin, polyester resin, nitrogen containing resin, sulfur containing resin, fluoro-resin, silicone resin, polyacetal resin, epoxy resin, polyether ketone resin and phenol resin;

a first switch for powering the regenerating apparatus:

a second switch for instructing a start of the regenerating apparatus; and a controller for automatically driving the supplying means when the first switch is turned on regardless of instruction by the second switch.

10. The regenerating apparatus of claim 9 further comprising:

a timer for counting time passed from a regenerating operation previously executed; and a controller for automatically driving the supplying means when the time counted by the timer is greater than a predetermined time.

11. A regenerating apparatus removing a printing material from a recording media comprising:

a transfer member which is in contact with the recording media and receives the printing material;

means for removing residual printing material from the recording media; and the transfer member being formed with at least one material selected from the group consisting of polyolefin resin, polyester resin, nitrogen containing resin, sulfur containing resin, fluoro-resin, silicone resin, polyacetal resin, expoxy resin, polyether ketone resin and phenol resin.

12. The regenerating apparatus of claim 11 wherein the removing means is a rotating brush.

13. The regenerating apparatus of claim 12 further comprising a recovery container for collecting the removed residual printing material.

14. The regenerating apparatus of claim 13 further comprising a red in contact with the rotating brush in order to oscillate the rotating brush.

15. A regenerating apparatus removing a printing material from a media which is printed by the printing material comprising:

means for accommodating cleaning material;

means for transporting the media into the tank in order to make contact between the media and the cleaning material;

means for squeezing the cleaning material from the media; and means for removing the residual printing material from the media from which the cleaning material is squeezed by the squeezing means.

16. The regenerating apparatus of claim 15 further comprising recovering means for recovering the cleaning material from the squeezing means to the accommodating means.

17. The regenerating apparatus of claim 16 wherein the accommodating means is a tank having an opening and the recovering means is a plate which is provided on an edge of the opening of the tank.

18. The regenerating apparatus of claim 15 wherein the squeezing means is a pair of rotating rollers.

19. The regenerating apparatus of claim 15 wherein the removing means has a surface which receives the printing material, said surface being formed with at least one material selected from the group consisting of polyolefin resin, polyester resin, nitrogen containing resin, sulfur containing resin, fluoro-resin, silicone resin, polyacetal resin, epoxy resin, polyether ketone resin and phenol resin.

* * * * *

UNITED STATES PATENT AND TRADEMARK OFFICE

CERTIFICATE OF CORRECTION

PATENT NO. : 5,689,754

DATED : November 18, 1997

INVENTOR(S) : Masazumi Yoshida, et al.

It is certified that error appears in the above-indentified patent and that said Letters Patent is hereby corrected as shown below:

Column 19, line 17 delete "expoxy" and insert --epoxy--.

Column 19, line 25 delete "red" and insert --rod--.

Signed and Sealed this

Sixteenth Day of June, 1998

*Attest:*

*Attesting Officer*

BRUCE LEHMAN

*Commissioner of Patents and Trademarks*